US006573862B2

(12) United States Patent
Vail et al.

(10) Patent No.: US 6,573,862 B2
(45) Date of Patent: Jun. 3, 2003

(54) PHASED ARRAY ANTENNA INCLUDING ELEMENT CONTROL DEVICE PROVIDING FAULT DETECTION AND RELATED METHODS

(75) Inventors: David Kenyon Vail, West Melbourne, FL (US); Frank J. Tabor, Melbourne, FL (US); Daniel P. Blom, Palm Bay, FL (US); Stephen S. Wilson, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 36 days.

(21) Appl. No.: 09/991,268

(22) Filed: Nov. 9, 2001

(65) Prior Publication Data

US 2002/0070894 A1 Jun. 13, 2002

Related U.S. Application Data

(60) Provisional application No. 60/255,007, filed on Dec. 12, 2000.

(51) Int. Cl.[7] ..... H01Q 3/22

(52) U.S. Cl. ..... 342/368; 342/174; 342/372

(58) Field of Search ..... 342/368, 371, 342/372, 377, 174; 343/700 MS; 714/733, 734, 735, 742

(56) References Cited

U.S. PATENT DOCUMENTS

| | | | | |
|---|---|---|---|---|
| 4,931,803 | A | 6/1990 | Shimko | 342/371 |
| 4,980,691 | A | 12/1990 | Rigg et al. | 342/372 |
| 4,994,814 | A | 2/1991 | Aoki et al. | 342/372 |
| 4,996,532 | A | 2/1991 | Kirimoto et al. | 342/81 |
| 5,008,680 | A | 4/1991 | Willey et al. | 342/372 |
| 5,027,126 | A | 6/1991 | Basehgi et al. | 342/372 |
| 5,072,228 | A | 12/1991 | Kuwahara | 342/360 |
| 5,225,841 | A | 7/1993 | Krikorian et al. | 342/204 |

(List continued on next page.)

OTHER PUBLICATIONS

McHugh, Pat et al, "IEEE P1149.5 Standard Module Test and Maintenance Bus" Electro International 1996 Conference Proceedings, pp. 757–767, May 1994.*

McLeod, G. R., "Built–in System Test and Fault Location," Proceedings of the International Test Conference, pp.291–299, Oct. 1994.*

Lofgren, John, "A Generic Test and Maintenance Node For Embedded System Test," Proceedings of the International Test Conference, pp. 143–153, Oct. 1994.*

*Primary Examiner*—Gregory C. Issing
(74) *Attorney, Agent, or Firm*—Allen, Dyer, Doppelt, Milbrath & Gilchrist, P.A.

(57) ABSTRACT

A phased array antenna may include a substrate and a plurality of phased array antenna elements carried thereby and an element control device for at least one of the phased array antenna elements. The element control device may include an IC die including output circuitry, readback circuitry, and control circuitry connected to the output and readback circuitry. The element control device may further include an IC package surrounding the IC die, a plurality of output terminals connected to the output circuitry and extending outwardly from the IC package, and a plurality of readback input terminals connected to the readback circuitry and extending outwardly from the IC package. Further, respective external readback connections may extend between the plurality of output terminals and the plurality of readback input terminals. The control circuitry may cause the output circuitry to output signals on the plurality of output terminals to be read back for fault detection.

46 Claims, 3 Drawing Sheets

U.S. PATENT DOCUMENTS

| | | | | | |
|---|---|---|---|---|---|
| 5,231,405 | A | | 7/1993 | Riza | 342/375 |
| 5,243,274 | A | | 9/1993 | Kelsey et al. | 324/158 R |
| 5,253,188 | A | * | 10/1993 | Lee et al. | 702/183 |
| 5,283,587 | A | | 2/1994 | Hirshfield et al. | 342/372 |
| 5,353,031 | A | | 10/1994 | Rathi | 342/372 |
| 5,398,250 | A | * | 3/1995 | Nozuyama | 714/726 |
| 5,493,255 | A | | 2/1996 | Murtojarvi | 330/296 |
| 5,559,519 | A | | 9/1996 | Fenner | 342/174 |
| 5,592,179 | A | | 1/1997 | Windyka | 342/372 |
| 5,655,841 | A | | 8/1997 | Storm | 374/183 |
| 5,680,141 | A | | 10/1997 | Didomenico et al. | 342/372 |
| 5,771,016 | A | | 6/1998 | Mullins et al. | 342/372 |
| 5,938,779 | A | | 8/1999 | Preston | 714/718 |
| 5,990,830 | A | | 11/1999 | Vail et al. | 342/368 |
| 5,995,740 | A | | 11/1999 | Johnson | 395/500.41 |
| 5,999,990 | A | | 12/1999 | Sharrit et al. | 718/8 |
| 6,011,512 | A | | 1/2000 | Cohen | 342/372 |
| 6,023,742 | A | | 2/2000 | Ebeling et al. | 710/107 |
| 6,127,966 | A | * | 10/2000 | Erhage | 342/174 |
| 6,157,681 | A | | 12/2000 | Daniel et al. | 375/298 |
| 6,163,220 | A | | 12/2000 | Schellenberg | 330/295 |
| 6,172,642 | B1 | | 1/2001 | DiDomenico et al. | 342/368 |

* cited by examiner

PHASED ARRAY ANTENNA INCLUDING ELEMENT CONTROL DEVICE PROVIDING FAULT DETECTION AND RELATED METHODS

RELATED APPLICATION

This application is based upon prior filed copending provisional application Ser. No. 60/255,007 filed Dec. 12, 2000, the entire subject matter of which is incorporated herein by reference in its entirety.

FIELD OF THE INVENTION

The present invention relates to the field of communications, and, more particularly, to phased array antennas and element control devices therefor.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antennas, combine the outputs of multiple antenna elements with signal processing capabilities to transmit and/or receive communications signals. As a result, such antenna systems can vary the transmission or reception pattern of the communications signals in response to the signal environment to improve performance characteristics.

In such antennas, one or more antenna elements are typically controlled by a phase shifter, attenuator, delay generator, etc., which in turn are controlled by element control circuitry. Such element control circuitry may be implemented in an application specific integrated circuit (ASIC), for example, which may be housed within an element module along with RF control devices such as phase shifters, attenuators, delay generators, amplifiers, etc. The control ASIC provides an interface between the array controller and these RF control devices.

One problem that may be encountered when using ASICs is ensuring that a control ASIC does not suffer from design or manufacturing defects that will affect its operation. ASIC testers are therefore commonly used to determine whether the ASIC design provides the intended result, and whether the ASIC was implemented properly during manufacture.

An example of an ASIC tester is disclosed in U.S. Pat. No. 5,243,274 to Kelsey. The tester includes a microprocessor and a test vector random access memory (RAM) bank on a test board. The RAM bank stores the vector information for the device under test (DUT) input/output pins. In addition, the test also includes several test ASICs located on the test board between the RAM bank and the DUT. The test ASICs are configurable with respect to the particular DUT to control the direction of the data lines and to compare the results of the DUT with pre-loaded RAM data.

Some ASICs are also designed to include self-testing capabilities. For example, output signals may be written to an output register, which in turn outputs the signals from the ASIC. Data written to the output register is internally fed back within the ASIC die to control logic for fault determination. Yet, while such internal test methodology may be used to determine whether the correct data is being provided to the output drivers, it does not determine whether faults have occurred at the ASIC driver outputs or "downstream" therefrom. For example, output faults, such as an open or short circuit, which may occur along the signal path from the output drivers to the output bonding pads of the control ASIC to the output terminals of the ASIC's packaging may well go undetected when using only a conventional ASIC self-test. Another problem is that ASIC built-in self-tests typically require that the ASIC cease normal operation to diagnose faults.

SUMMARY OF THE INVENTION

In view of the foregoing background, it is therefore an object of the invention to provide a phased array antenna and associated methods which provides fault detection of element control device ASICs.

This and other objects, features, and advantages in accordance with the present invention are provided by a phased array antenna which may include a substrate and a plurality of phased array antenna elements carried thereby and an element control device for at least one of said phased array antenna elements. Each element control device may include an IC die comprising output circuitry, readback circuitry, and control circuitry connected to the output and readback circuitry. The element control device may further include an IC package surrounding the IC die, a plurality of output terminals connected to the output circuitry and extending outwardly from the IC package, and a plurality of readback input terminals connected to the readback circuitry and extending outwardly from the IC package. Further, respective external readback connections may extend between the plurality of output terminals and the plurality of readback input terminals. The control circuitry may cause the output circuitry to output signals on the plurality of output terminals. This is done so that the readback circuitry reads back the output signals via the external readback connections and the plurality of readback input terminals for fault detection.

More specifically, the control circuitry may generate fault detection signals based upon comparing output signals to readback signals. For example, the output signals may be a test pattern sequence during off-line testing, or normal commanded values for testing during normal on-line operation. The phased array antenna may further include an array controller connected to the element control device for receiving fault detection signals therefrom, and the array controller may optionally shut off the element control device based upon a fault detection signal received therefrom. Alternately, the array controller may compare respective output signals to readback signals for fault detection and optionally shut off the element control device based thereon. The array controller may also send output signals to the element control device. More particularly, the array controller may periodically send the output signals to the element control device.

Furthermore, the output circuitry may include at least one register, and the readback circuitry may also include at least one register. The IC die may include a plurality of output bond pads and a plurality of readback input bond pads, and the element controller may also include respective bond wires extending between the output bond pads and the output terminals and between the readback input bond pads and the readback input terminals.

The IC die may be an ASIC, for example. Also, the output signals may be digital output signals. Each of the output terminals may include an electrically conducting lead, and each of the readback input terminals may also include an electrically conducting lead. Additionally, the element control device may also include RF control devices, such as phase shifters, attenuators, delay generators, amplifiers, etc., connected to the plurality of output terminals.

Another aspect of the invention relates to an element control device for an antenna element of a phased array antenna. The element control device may include an IC die comprising output circuitry, readback circuitry, and control circuitry connected to the output and readback circuitry. The element control device may also include an IC package surrounding the IC die, a plurality of output terminals connected to the output circuitry and extending outwardly from the IC package, and a plurality of readback input terminals connected to the readback circuitry and extending outwardly from the IC package. The plurality of output terminals are to be connected to respective readback terminals via external readback connections. Further, the control circuitry may cause the output circuitry to output signals on the plurality of output terminals. This is done so that the readback circuitry reads back the output signals via the external readback connections and the plurality of readback input terminals for fault detection. For example, the output signals may be a test pattern sequence (generated by the control circuitry) during off-line testing, or normal commanded values for testing during normal on-line operation.

A method aspect of the invention is for testing an element control device for an antenna element of a phased array antenna. The element control device may be as described above. The method may include connecting the plurality of output terminals to respective readback terminals using external readback connections, causing the output circuitry to output signals on the plurality of output terminals, and reading back the output signals via the external readback connections and the plurality of readback input terminals using the readback circuitry. Further, fault detection may be performed by comparing output signals to readback signals.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
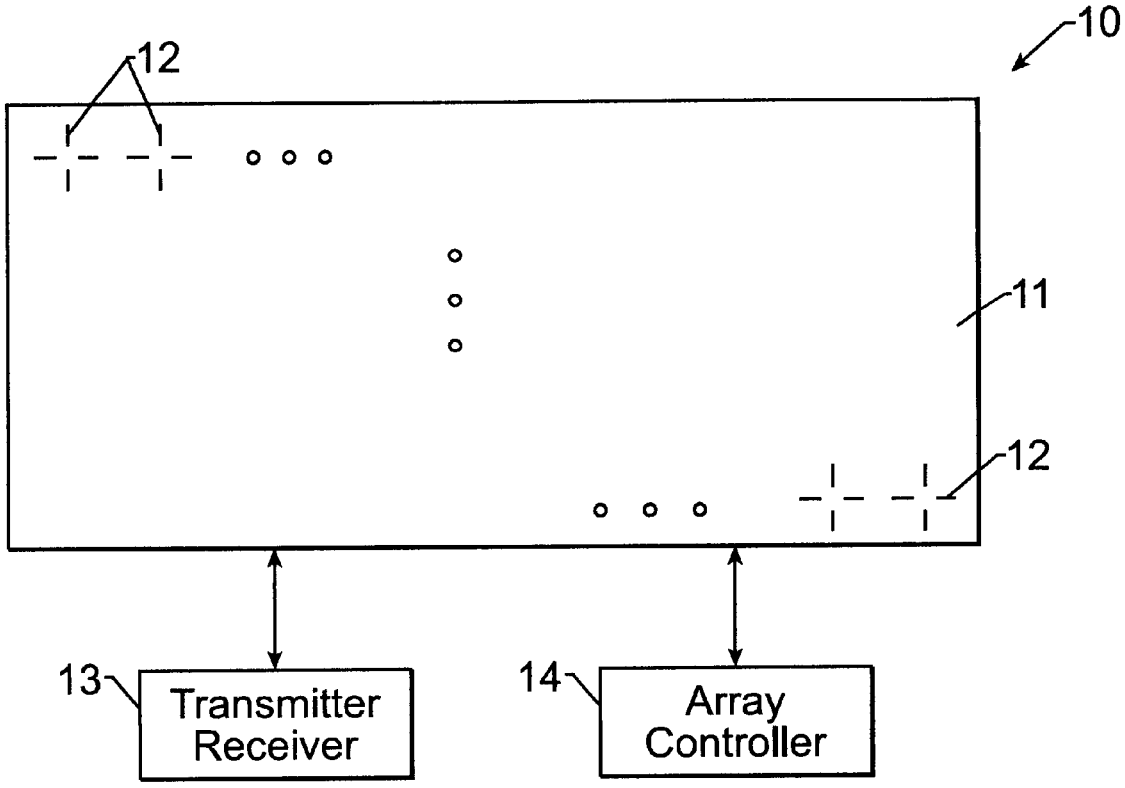
FIG. 1 is schematic block diagram of a phased array antenna according to the present invention.

Turning now to FIG. 1, a phased array antenna 10 according to the invention includes a substrate 11 and a plurality of phased array antenna elements 12 carried thereby. The phased array antenna 10 may also include a transmitter and/or receiver 13 for sending and receiving communications signals (e.g., RF signals) via the antenna elements 12, and an array controller 14, which will be described further below. The phased array antenna 10 may be used for ground, airborne, or spaceborne applications, as will be readily understood by those skilled in the art.

Figure 2:
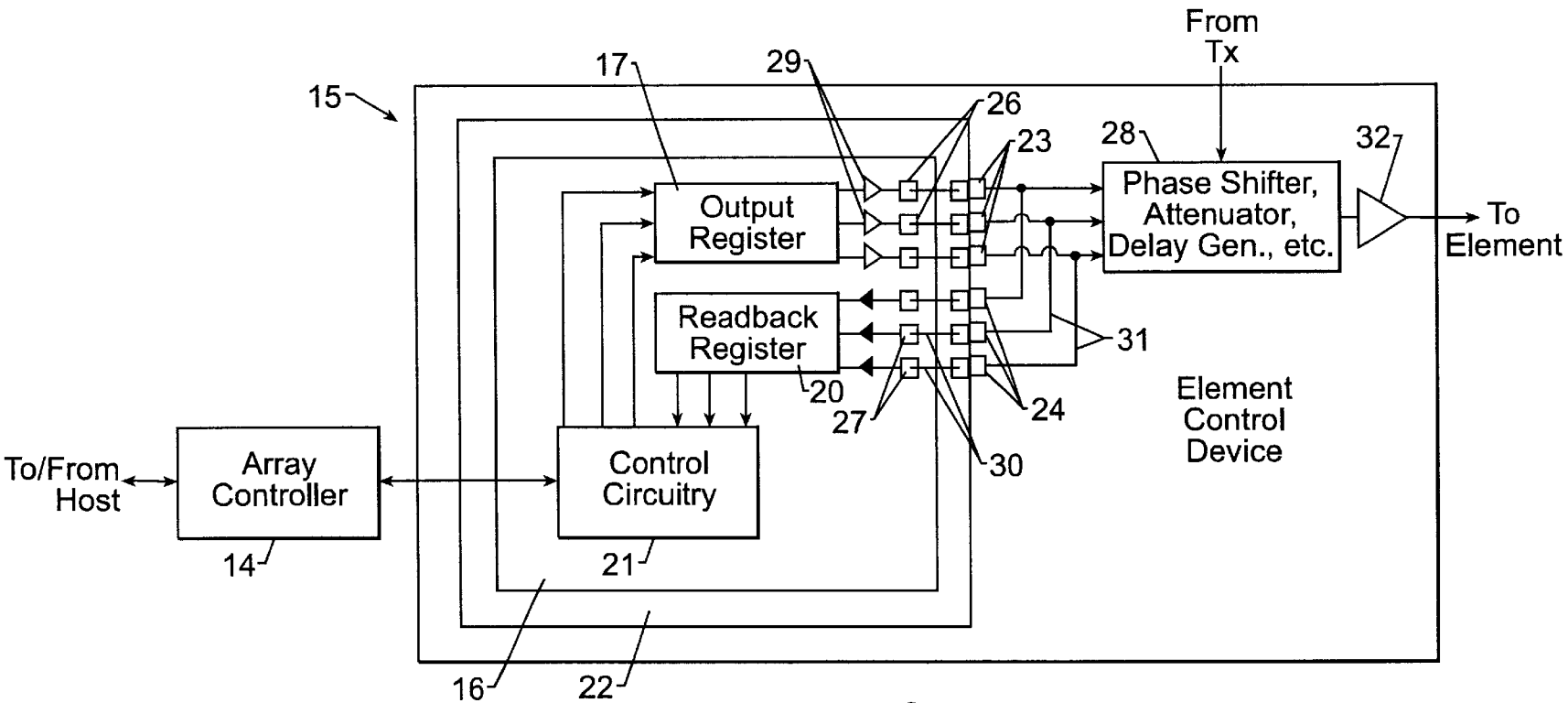
FIG. 2 is a schematic block diagram of an element control device of the phased array antenna of FIG. 1.

Referring now additionally to FIG. 2, the phased array antenna 10 may also include an element control device 15 for one or more of the antenna elements 12. The element control devices 15 may be carried by the substrate 11, for example, though other suitable mounting configurations known to those of skill in the art are also possible. Each element control device 15 may include an IC die 16, such as an ASIC, for example. The IC die 16 may include output circuitry 17, readback circuitry 20, and control circuitry 21 connected to the output and readback circuitry. More specifically, the output circuitry 17 and readback circuitry 20 may each include one or more registers, for example. Additionally, a digital multiplexer (not shown) may also be connected to the input of the readback circuitry (i.e., register) 20 so that one readback register can read from several outputs, as will be appreciated by those of skill in the art.

The element control device 15 may further include an IC package 22 surrounding the IC die 16 and a plurality of output terminals 23 connected to the output circuitry 17 and extending outwardly from the IC package. Further, a plurality of readback input terminals 24 are connected to the readback circuitry 20 and extend outwardly from the IC package 22. By way of example, each of the output terminals 23 and readback input terminals 24 may be an electrically conducting lead. As used herein, "lead" is meant to include any lead, pin, or other suitable terminals or connections such as a wire bonded die inside an RF hybrid, a ball or pin grid array package, leadless chip carrier packages, etc.

Additionally, each element control device 15 may also include one or more RF control devices 28, such as phase shifters, attenuators, delay generators, etc., connected to the output terminals 23. Each RF control device 28 adjusts the phase, attenuation, delay, etc., of transmission and/or reception of its respective antenna element 12 based upon control data provided by the array controller 14. A single transmission amplifier 32 is shown in FIG. 2 for clarity of illustration, but those of skill in the art will appreciate that additional transmission amplifiers and/or reception amplifiers may be included as well. It should be noted that while each element control device 15 is described herein as controlling a single, respective antenna element 12, the element control device may be used to control one or more antenna elements, as will be appreciated by those of skill in the art.

The IC die 16 illustratively includes a plurality of output bond pads 26, output drivers 29 connected between the output circuitry 17 and the output bond pads, and a plurality of readback input bond pads 27. Respective bond wires 30 extend between the output bond pads 26 and the output terminals 23, and between the readback input bond pads 27 and the readback input terminals 24, as will be understood by those of skill in the art.

According to the invention, the element control device 15 may also include respective external readback connections 31 extending between the plurality of output terminals 23 and the plurality of readback input terminals 24, as schematically shown in FIG. 2. For example, the element control device may be implemented using a circuit board, and the external readback connections 31 may be traces on the circuit board. Another implementation is inside an RF hybrid module. Other suitable methods of implementation and connections which will be appreciated by those of skill in the art may also be used.

As a result of the external readback connections 31, the control circuitry 21 may cause the output circuitry 17 to output signals on the plurality of output terminals 23 so that the readback circuitry 20 reads back the output signals via the external readback connections 31 and the readback input terminals 24. For example, the output signals may be a test pattern sequence generated by control circuitry 21 during "off-line" testing, or normal commanded values for testing during normal "on-line" operation.

Thus, fault detection may be performed by comparing the known output signals with the readback signals to determine whether any output faults exist at the output drivers 29, output bond pads 26, output terminals 23, or bond wires 30 extending therebetween. That is, since the output signals from the output circuitry 17 are externally read back to the control circuitry 21, faults occurring along the signal flow path up through the output terminals 23 may be detected, as opposed to simply detecting internal faults as in the prior art devices described above. Additionally, these faults may be detected to some extent during normal on-line operation. That is, performing on-line fault testing using normal commanded values in some applications may not provide as many potential test values as would a test pattern sequence, as will be appreciated by those of skill in the art, though such testing may nonetheless be very advantageous.

More specifically, for off-line testing, for example, the output signals may be digital output signals which toggle the output on each of the output terminals 23 between logic 0 and logic 1. Such output signals will not only verify that the outputs of the output circuitry 17 are controllable and not stuck high or low, but the proper connectivity of the output bond pads 26, bond wires 30, and output terminals 23 will also be verified (i.e., bridging faults can be detected).

The output signals may be generated by the control circuitry 21, for example, in response to a command from the array controller 14 to perform the test. Alternately, the array controller 14 may send the output signals to the element control devices 15. Furthermore, the output signals may advantageously be periodically output to the output terminals 23 to thus provide ongoing fault detection. This allows faults which are not manifest at the time of manufacture to be later detected during operation.

The control circuitry 21 may perform the fault detection by comparing the output signals stored in the output circuitry 17 to the readback signals stored in the readback circuitry 20, for example. Of course, the appropriate data could also be transmitted to the array controller 14 so that it may perform the fault detection, if desired, as will be appreciated by those of skill in the art.

Upon detection of a fault, the control circuitry 21 may generate a fault detection signal. The array controller 14 receives the fault detection signals from the element control devices 15 and may report the fault via telemetry, for example, to a host system (not shown). The array controller 14 may also shut off a respective element control device 15 based upon the fault detection signal received therefrom. Furthermore, the array controller 14 may record a time that a particular element control device 15 was in service before a fault detection signal was received therefor. Such information may be useful to designers in that it may help them discern how long the service life of a particular IC die 16 will be in various applications, for example.

While the present invention advantageously allows ongoing fault detection, those of skill in the art will also appreciate that the present invention also allows for testing of the output drivers 29, output bond pads 26, readback input bond pads 27, bond wires 30, output terminals 23, and readback input terminals 24 before the element control device 15 is completely assembled. Thus, repair of the bond wires 30 or other problems may be corrected as part of the element control device 15 manufacturing process. Further, it should also be noted that the present invention may be relatively easily implemented within many typical element control ASICs. This is because such ASICs often have spare input/output bonding pads available, which may make implementation of the invention relatively inexpensive as well. Additionally, the readback circuitry 20 may be designed to be inactive until a test is performed so the power requirements of the IC die 16 are not unduly increased.

Figure 3:
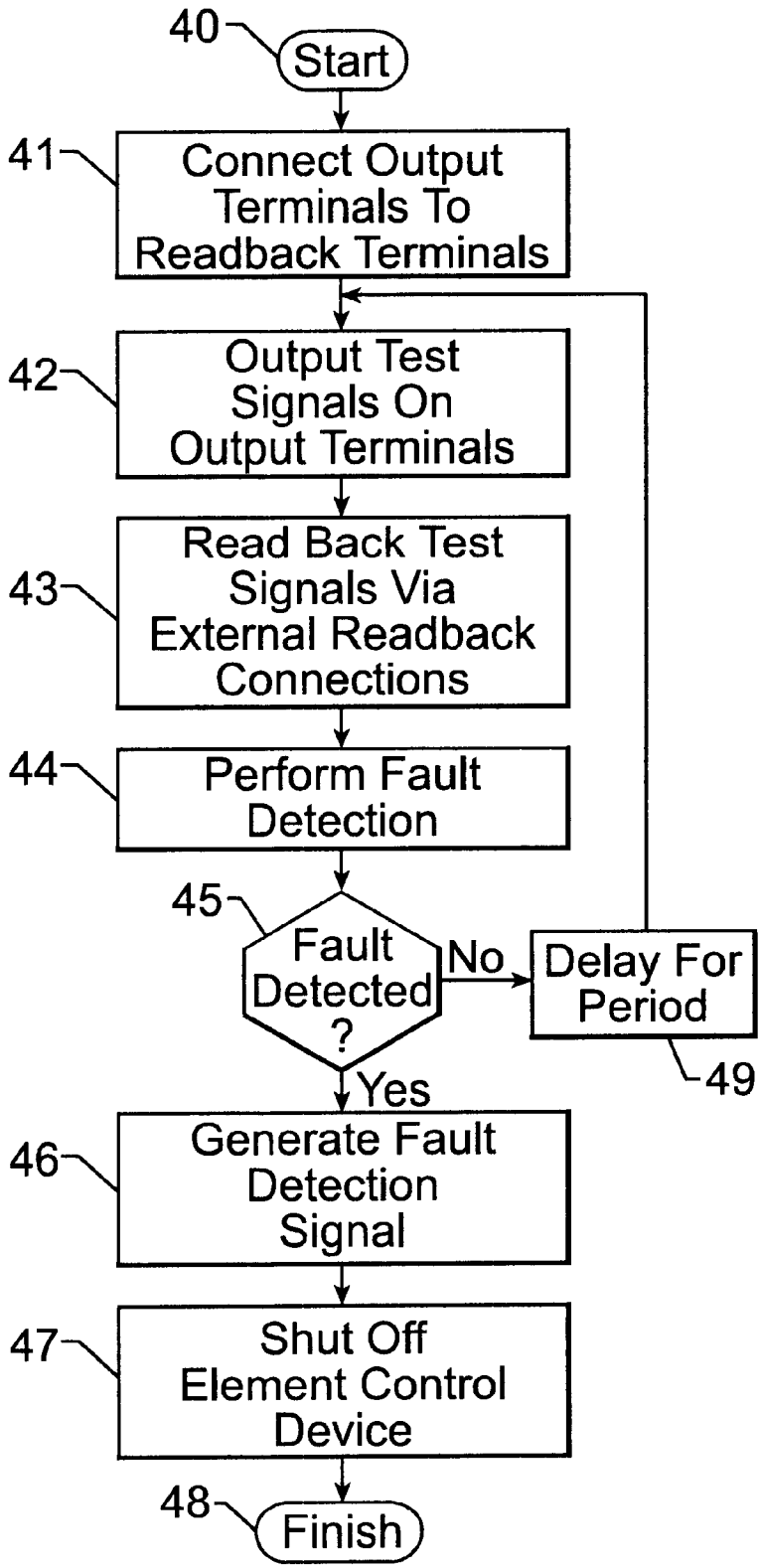
FIG. 3 is a flow diagram of a method according to the present invention for testing an element control device for an antenna element of a phased array antenna.

Turning now to FIG. 3, a method aspect of the invention for testing the element control device 15 is now described. The method begins (Block 40) by connecting the output terminals 23 to respective readback terminals 24 using the external readback connections 31, at Block 41. Typically, these connections would be made at the time of manufacturing and would be a permanent part of the basic circuit connections, as will be appreciated by those of skill in the art. The method may further include causing the output circuitry 17 to output the output signals on the output terminals 23, at Block 42 (e.g., during off-line testing). By way of example, a digital test pattern may be used which may include true/complement patterns, marching logic 1's, marching logic 0's, etc. The test patterns may be generated by the array controller 14, or an on-chip hardware generator, for example, as will be appreciated by those of skill in the art. Those of skill in the art will appreciate that on-line testing during normal operation using the readback connections may also be performed according to the present invention to verify that the outputs are being driven to the proper logic state.

Furthermore, the method may also include reading back the output signals via the external readback connections 31 and the readback input terminals 24 using the readback circuitry 20, at Block 43, as described above. Further, fault detection may be performed by comparing output signals to readback signals (Block 44) either using the control circuitry 21 or the array controller 14, for example, as noted above.

If a fault is not detected (Block 45), then if periodic testing is to be performed as described above the steps illustrated at Blocks 42–43 will be repeated after a predetermined period (Block 49). Yet, if a fault is detected, at Block 45, then a fault detection signal may be generated by the control circuitry 21 of the element control device 15 in question. Of course, as noted above, the fault detection may be performed by the array controller 14 in some embodiments, thus the step illustrated at Block 46 of generating the fault detection signal may be performed by the array controller 14. In either event, upon detection of a fault, the array controller 14 may then shut off the particular element control device 15 in which the fault was detected, at Block 47, thus ending the method (Block 48). Alternately, the array controller 14 may report any detected faults to a host system for appropriate maintenance or fault recovery activities.

Accordingly, it will be appreciated by those of skill in the art that the present invention advantageously provides a closed-loop test for verifying that the IC die 16 is operating properly, including the output drivers 29 and bond wires 30, which would not otherwise be possible using prior art testing methods. Furthermore, such closed-loop testing according to the present invention allows high confidence fault isolation between the control circuitry 21 and other circuitry (e.g., RF circuitry) of the phased array antenna 10. Moreover, such testing may advantageously be implemented with little if any additional cost by using otherwise unused input/outputs of the IC die 16, plus a minimal amount of test control logic on the IC die. This test control logic may be implemented with gate logic resources which often go unused used in many phased array antenna applications.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a substrate and a plurality of phased array antenna elements carried thereby; and an element control device for at least one of said phased array antenna elements and comprising an IC die comprising output circuitry, readback circuitry, and control circuitry connected to said output and readback circuitry, an IC package surrounding said IC die, a plurality of output terminals connected to said output circuitry and extending outwardly from said IC package, a plurality of readback input terminals connected to said readback circuitry and extending outwardly from said IC package, and respective external readback connections extending between said plurality of output terminals and said plurality of readback input terminals, said control circuitry causing said output circuitry to output signals on said plurality of output terminals so that said readback circuitry reads back the output signals via said external readback connections and said plurality of readback input terminals for fault detection.

2. The phased array antenna of claim 1 wherein said control circuitry generates fault detection signals based upon comparing output signals to readback signals.

3. The phased array antenna of claim 2 further comprising an array controller connected to said element control devices for receiving fault detection signals therefrom.

4. The phased array antenna of claim 3 wherein said array controller shuts off a respective element control device based upon a fault detection signal received therefrom.

5. The phased array antenna of claim 1 further comprising an array controller connected to said element control devices for sending output signals thereto.

6. The phased array antenna of claim 5 wherein said array controller periodically sends the output signals to said element control device.

7. The phased array antenna of claim 1 further comprising an array controller connected to said element control device for comparing respective output signals to readback signals for fault detection.

8. The phased array antenna of claim 7 wherein said array controller shuts off said element control device based upon fault detection.

9. The phased array antenna of claim 1 wherein said output circuitry comprises at least one register.

10. The phased array antenna of claim 1 wherein said readback circuitry comprises at least one register.

11. The phased array antenna of claim 1 wherein said IC die comprises a plurality of output bond pads and a plurality of readback input bond pads; and further comprising respective bond wires extending between said output bond pads and said output terminals and between said readback input bond pads and said readback input terminals.

12. The phased array antenna of claim 1 wherein said IC die comprises an ASIC.

13. The phased array antenna of claim 1 wherein the output signals comprise digital output signals.

14. The phased array antenna of claim 1 wherein each of said output terminals comprises an electrically conducting lead; and wherein each of said readback input terminals comprises an electrically conducting lead.

15. The phased array antenna of claim 1 wherein said element control device further comprises a phase shifter connected to said plurality of output terminals.

16. A phased array antenna comprising:

a substrate and a plurality of phased array antenna elements carried thereby; and a respective element control device for each phased array antenna element and comprising an IC die comprising at least one output register, at least one readback register, and control circuitry connected to said at least one output register and said at least one readback register, an IC package surrounding said IC die, a plurality of output terminals connected to said at least one output register and extending outwardly from said IC package, a plurality of readback input terminals connected to said at least one readback register and extending outwardly from said IC package, and respective external readback connections extending between said plurality of output terminals and said plurality of readback input terminals, said control circuitry causing said at least one output register to output digital output signals on said plurality of output terminals so that said at least one readback register reads back the digital output signals via said external readback connections and said plurality of readback input terminals for fault detection.

17. The phased array antenna of claim 16 wherein said control circuitry generates fault detection signals based upon comparing digital output signals to readback signals.

18. The phased array antenna of claim 17 further comprising an array controller connected to said element control devices for receiving fault detection signals therefrom.

19. The phased array antenna of claim 18 wherein said array controller shuts off a respective element control device based upon a fault detection signal received therefrom.

20. The phased array antenna of claim 16 further comprising an array controller connected to said element control devices for sending digital output signals thereto.

21. The phased array antenna of claim 20 wherein said array controller periodically sends the digital output signals to said element control devices.

22. The phased array antenna of claim 16 further comprising an array controller connected to said element control devices for comparing respective digital output signals to readback signals for fault detection.

23. The phased array antenna of claim 22 wherein said array controller shuts off a respective element control device based upon fault detection.

24. The phased array antenna of claim 16 wherein said IC die comprises a plurality of output bond pads and a plurality of readback input bond pads; and further comprising respective bond wires extending between said output bond pads and said output terminals and between said readback input bond pads and said readback input terminals.

25. The phased array antenna of claim 16 wherein said IC die comprises an ASIC.

26. The phased array antenna of claim 16 wherein each of said output terminals comprises an electrically conducting lead; and wherein each of said readback input terminals comprises an electrically conducting lead.

27. The phased array antenna of claim 16 wherein each element control device further comprises a phase shifter connected to said plurality of output terminals.

28. An element control device for an antenna element of a phased array antenna, the element control device comprising:

an integrated circuit (IC) die comprising output circuitry, readback circuitry, and control circuitry connected to said output and readback circuitry;

an IC package surrounding said IC die;

a plurality of output terminals connected to said output circuitry and extending outwardly from said IC package; and a plurality of readback input terminals connected to said readback circuitry and extending outwardly from said IC package, said plurality of output terminals to be also connected to respective readback terminals via external readback connections;

said control circuitry causing said output circuitry to output signals on said plurality of output terminals so that said readback circuitry reads back the output signals via the external readback connections and the plurality of readback input terminals for fault detection.

29. The element control device of claim 28 wherein said control circuitry generates fault detection signals based upon comparing output signals to readback signals.

30. The element control device of claim 28 wherein said output circuitry comprises at least one register.

31. The element control device of claim 28 wherein said readback circuitry comprises at least one register.

32. The element control device of claim 28 wherein said IC die comprises a plurality of output bond pads and a plurality of readback input bond pads; and further comprising respective bond wires extending between said output bond pads and said output terminals and between said readback input bond pads and said readback input terminals.

33. The element control device of claim 28 wherein said IC die comprises an ASIC.

34. The element control device of claim 28 wherein the output signals comprise digital output signals.

35. The element control device of claim 28 wherein each of said output terminals comprises an electrically conducting lead; and wherein each of said readback input terminals comprises an electrically conducting lead.

36. The element control device of claim 28 wherein said element control device further comprises a phase shifter connected to said plurality of output terminals.

37. A method for testing an element control device for an antenna element of a phased array antenna, the element control device comprising an integrated circuit (IC) die comprising output circuitry and readback circuitry, an IC package surrounding the IC die, a plurality of output terminals connected to the output circuitry and extending outwardly from the IC package, and a plurality of readback input terminals connected to the readback circuitry and extending outwardly from the IC package, the method comprising:

connecting the plurality of output terminals to respective readback terminals using external readback connections;

causing the output circuitry to output signals on the plurality of output terminals;

reading back the output signals via the external readback connections and the plurality of readback input terminals using the readback circuitry; and performing fault detection by comparing output signals to readback signals.

38. The method of claim 37 further comprising generating fault detection signals based upon fault detection.

39. The method of claim 37 wherein causing the output circuitry to output signals comprises causing the output circuitry to periodically output signals on the plurality of output terminals.

40. The method of claim 37 further comprising shutting off the element control device based upon fault detection.

41. The method of claim 37 wherein the output circuitry comprises at least one register.

42. The method of claim 37 wherein the readback circuitry comprises at least one register.

43. The method of claim 37 wherein the IC die comprises a plurality of output bond pads and a plurality of readback input bond pads; and further comprising respective bond wires extending between the output bond pads and the output terminals and between the readback input bond pads and the readback input terminals.

44. The method of claim 37 wherein the IC die comprises an ASIC.

45. The method of claim 37 wherein the output signals comprise digital output signals.

46. The method of claim 37 wherein each of the output terminals comprises an electrically conducting lead; and wherein each of the readback input terminals comprises an electrically conducting lead.

* * * * *